US005277002A

United States Patent [19]

Haag

[11] Patent Number: 5,277,002

[45] Date of Patent: Jan. 11, 1994

[54] RIDGE CAP CONNECTOR MEANS FOR JOINING ROOF PANELS IN A MODULAR BUILDING STRUCTURE

[76] Inventor: E. Keith Haag, 1007 W. Steels Corners Rd., Cuyahoga Falls, Ohio 44223

[21] Appl. No.: 893,532

[22] Filed: Jun. 4, 1992

Related U.S. Application Data

[63] Continuation-in-part of Ser. No. 792,356, Nov. 14, 1991, Pat. No. 5,245,803.

[51] Int. Cl.[5] ..... E04B 7/00

[52] U.S. Cl. ..... 52/90.1; 52/79.9; 52/43; 52/54; 52/198; 52/762

[58] Field of Search ..... 52/90, 91, 92, 94, 95, 52/795, 79.9, 79.11, 79.13, 259, 260, 262, 263, 271, 272, 278, 283, 285, 289, 300, 761, 766, 699, 698, 743, 745.05, 745.13, 745.21, 582, 586, 284, 275, 127.11, 73, 43, 54, 199, 278, 281, 47, 575, 580, 198

[56] References Cited

U.S. PATENT DOCUMENTS

| | | | |
|---|---|---|---|
| 260,294 | 6/1882 | Hefele | 52/90 |
| 1,921,303 | 8/1933 | Raschka | 52/90 |
| 1,931,750 | 10/1933 | Blaski | 52/90 X |
| 1,998,448 | 4/1935 | Crowe . | |
| 2,071,666 | 2/1937 | Sylvan | 52/199 |
| 2,850,771 | 9/1958 | Wagner . | |
| 2,918,151 | 12/1959 | Kennedy . | |
| 3,229,431 | 1/1966 | Paul . | |
| 3,284,966 | 11/1966 | Bolt . | |
| 3,332,186 | 7/1967 | Cammaert | 52/90 X |
| 3,344,564 | 10/1967 | Siegal | 52/90 X |
| 3,388,514 | 6/1968 | Archinal et al. . | |
| 3,397,494 | 8/1968 | Waring . | |
| 3,397,496 | 8/1968 | Sohns . | |
| 3,423,891 | 1/1969 | Burris . | |
| 3,436,881 | 4/1969 | Schleet | 52/46 X |
| 3,641,720 | 2/1972 | Berrie | 52/220 X |
| 3,662,507 | 5/1972 | Espeland . | |
| 3,738,083 | 6/1973 | Shimano . | |
| 3,783,563 | 1/1974 | Moore . | |
| 3,828,502 | 8/1974 | Carlsson . | |
| 3,866,381 | 2/1975 | Eschbach et al. . | |
| 3,992,839 | 11/1976 | LaBorde . | |
| 4,183,185 | 1/1980 | Farge . | |
| 4,373,304 | 2/1983 | Howitt | 52/73 |
| 4,557,091 | 12/1985 | Auer . | |
| 4,756,127 | 7/1988 | Helterbrand et al. | 52/92 X |

FOREIGN PATENT DOCUMENTS

| | | | |
|---|---|---|---|
| 0160061 | 12/1954 | Australia | 52/278 |

*Primary Examiner*—Carl D. Friedman
*Assistant Examiner*—Robert Canfield
*Attorney, Agent, or Firm*—Renner, Kenner, Greive, Bobak, Taylor & Weber

[57] ABSTRACT

Ridge cap means adapted to secure one or more roof panel members to a modular building structure. Such a ridge cap means has a horizontally disposed base portion that is adapted to engage a supporting member incorporated in, and presented from, the modular building. An inclined, plate portion is supported from the base portion. The plate portion is adapted to receive, and support, the roof panel. A locking member frictionally secures each roof panel to one or more inclined plate portions.

9 Claims, 4 Drawing Sheets

RIDGE CAP CONNECTOR MEANS FOR JOINING ROOF PANELS IN A MODULAR BUILDING STRUCTURE

CROSS REFERENCE TO RELATED APPLICATION

This application is a continuation-in-part of my U.S. application Ser. No. 07/792,356, filed on Nov. 14, 1991, now U.S. Pat. No. 5,245,803 and captioned "Connector Means for Roof Panels and Method for Installation Thereof".

TECHNICAL FIELD

The present invention relates generally to modular building structures. More particularly, the present invention relates to connector means for modular building structures, the building structures to be constructed with a plurality of prefabricated structural components and being particularly adapted for use in third world countries. Specifically, the present invention relates to a roof-peak connector means that includes a novel ridge cap for securing roof panel members to each other at the ridge of the roof, the ridge cap connector means being particularly adapted for use in conjunction a modular building structure such that the roof may be erected in a relatively short time with the simplest of tools, and without the need for craftsmen skilled in the building trades.

BACKGROUND OF THE INVENTION

It is well known in the construction industry that significant economic savings can be realized by reducing the amount of work required at the construction site. To achieve this objective, prefabrication has been adopted on a large scale in the construction industry, both with respect to general purpose buildings and with respect to personal housing. For example, some sources have estimated that as many as forty percent (40%) of the homes now being built use some form of premanufactured structural components. Moreover, four and seven-tenths percent (4.7%) of all housing starts in the U.S. in 1991 are homes that are completely modular, and this percentage is expect to rise. The ultimate goal to be achieved in building modular structures has been to produce, at a remote site and in a factory environment, as many of the components of a given structure as possible, leaving only site preparation and final assembly to be done at the actual location where the building is to be situated.

There are a number of advantages to be achieved by prefabrication. The most obvious of those advantages is the significant reduction of time and labor required at the job site, where labor costs are normally the highest. In addition to the reduced time required for actual erection of the building, other time savings are also possible. For example, the reduced amount of work time at the job site reduces the potential for interruptions resulting from inclement weather. Reduced time at a job site can also drastically reduce the potential for work-related injuries and/or deaths. A controlled factory atmosphere is inherently amenable to measures for reducing injuries and increasing safety.

Furthermore, increased uniformity of the structural components resulting from the enhanced quality control possible in a factory atmosphere and the economic advantages of mass production techniques are also achievable with the prefabrication approach. As is often the situation, the use of standardized, prefabricated structural components not only improves the uniformity of the end product but also greatly simplifies the actual erection process. This last feature also makes it possible to produce quality buildings with unskilled, or minimally skilled, personnel. Thus, the overall results of prefabrication in the construction industry include greatly improved efficiency, significantly reduced costs, lower accident rates and better safety records.

These advantages are, of course desirable in any type of construction, but are believed to be especially important in the production of individual dwellings, particularly in economically distressed areas and in third world countries where cost is one of the most significant obstacles to overcome.

There are a wide variety of practical ways of to effectuate the prefabrication concept.

For example, the U.S. patent to Crowe—U.S. Pat. No. 1,988,448—discloses the factory prefabrication of steel frame panel units of standard dimensions which are filled with cementitious material and assembled so as to leave vertical spaces between adjacent vertical walls for utility connection and with laterally adjacent panels being joined by cover strips or slabs which are interconnected thereto.

The U.S. patent to Wagner—U.S. Pat. No. 2,850,771—discloses a prefabricated construction system wherein wooden panels are interconnected to vertical posts or columns with the vertical edges of the wooden wall panels and the posts having grooved areas and with spline blocks being used to interconnect the two.

The U.S. patent to Paul—U.S. Pat. No. 3,229,431—is indicative of another approach wherein a so-called "frameless" modular multi-story building is constructed from self-contained prefabricated modules which are simply set on a building foundation and attached thereto by anchor bolts secured in the foundation.

The U.S. patent to Bolt—U.S. Pat. No. 3,284,966—is of general interest in showing a prefabricated building which can be readily assembled or erected at the job site and which is collapsible for transportation purposes.

The U.S. patent to Moore—U.S. Pat. No. 3,783,563—discloses a prefabricated building constructed of panels formed of molded plastic material, reinforced with glass fibers, and wherein the panels have channels or ribs on their edges adapted to mate with complementary structures of connector members.

Other examples of prefabricated construction components utilizing various plastics materials can be seen in the U.S. patent to Kennedy—U.S. Pat. No. 2,918,151; the U.S. patent to Espeland—U.S. Pat. No. 3,662,507; the U.S. patent to Sohns—U.S. Pat. No. 3,397,496; and, the U.S. patent to Farge—U.S. Pat. No. 4,183,185.

The foregoing patents are believed to be generally representative of the prior art, and that art does illustrate some diverse approaches to the prefabrication of buildings using various materials. However, none of the aforesaid prior art patents, nor any other prior art with which the inventor is aware, either alone or in combination, achieve the several objects of the present invention.

SUMMARY OF THE INVENTION

It is, therefore, a primary object of the present invention to provide an improved ridge cap for incorporation as a component in a roof-peak connector means to be employed in a modular building structure.

It is another object of the present invention to provide ridge cap, as above, which can be used structurally to join roof panel members to each other with relatively unskilled laborers, and without specialized tools.

It is a further object of the present invention to provide an ridge cap, as above, which permits the erection, and connection, of roof panel members to their supporting structure and to each other in a far shorter period of time than heretofore possible.

It is still another object of the present invention to provide a ridge cap, as above, which can be mass produced at relatively modest expense and can then be conveniently shipped to a remote construction site, also at relatively modest cost.

It is yet another object of the present invention to provide a ridge cap, as above, which permits roof panel members to be erected with a much reduced number of work-related injuries and/or deaths than with more traditional construction methods.

It is still further object of the present invention to provide ridge cap, as above, a majority of the structural components for which may be prefabricated in a controlled working environment that inherently leads to reduced injuries and increased safety.

These and other objects of the invention, as well as the advantages thereof over existing and prior art forms, which will be apparent in view of the following detailed specification, are accomplished by means hereinafter described and claimed.

In general, a connector means embodying the concepts of the present invention is adapted to secure one or more roof panels to a modular building structure. Such a connector means has a horizontally disposed base that is adapted to engage a supporting member incorporated in the modular building. A pair of oppositely inclined plate portions are supported from the base. The plate portions are adapted to receive, and support, the roof panels at the apex of the roof. A locking member frictionally secures each roof panel to one of the inclined plate portions.

The description of two embodiments of a ridge cap embodying the concepts of the present invention are deemed sufficient to effect a full disclosure of the subject invention. The exemplary ridge caps are described in detail without attempting to show all of the various forms and modifications in which the invention might be embodied; the invention being measured by the appended claims and not by the details of the specification.

DESCRIPTION OF AN EXEMPLARY EMBODIMENT

Figure 1:
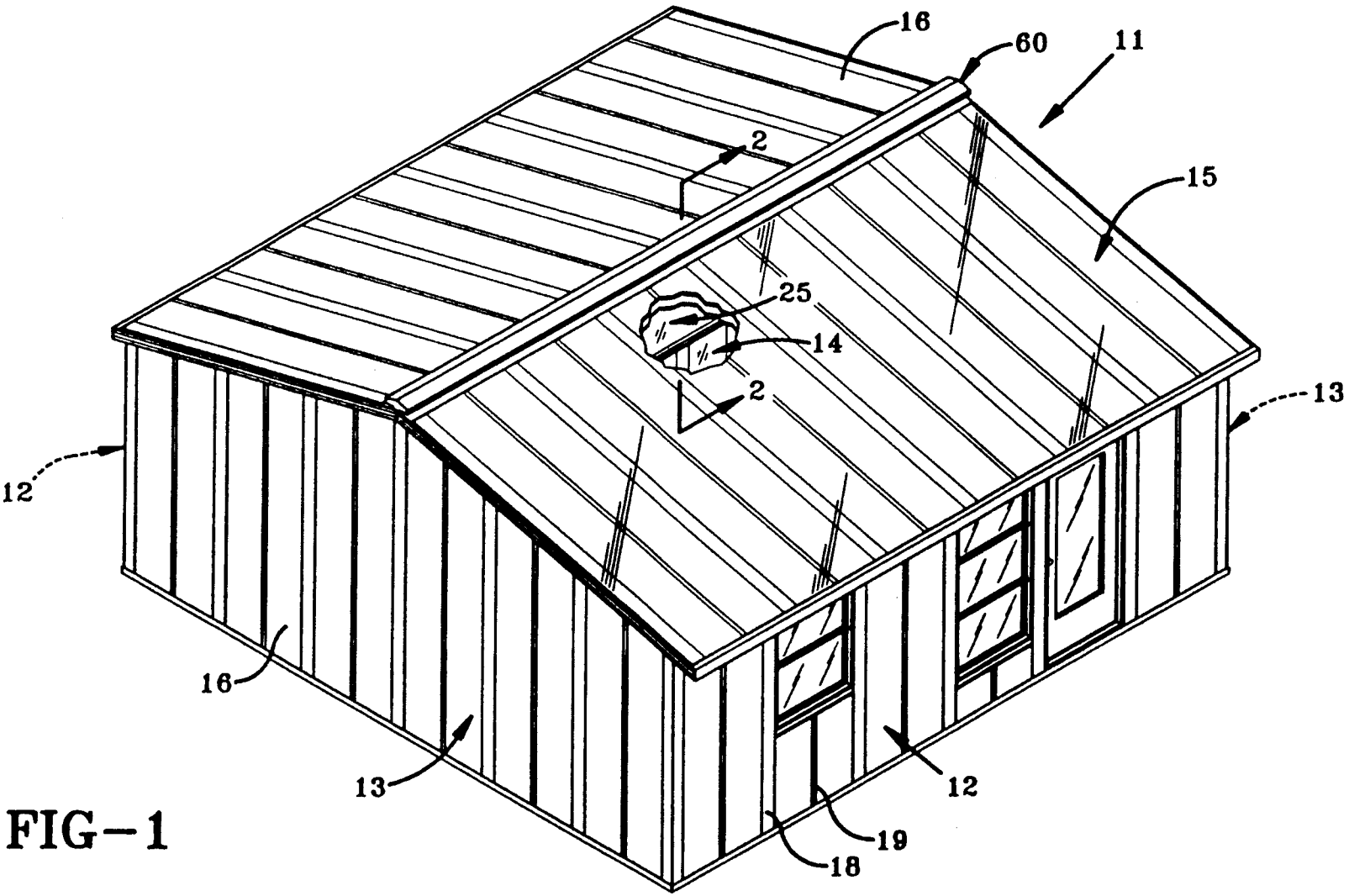
FIG. 1 is a perspective view of a modular building structure incorporating the present invention, said figure being partially broken away to depict an interior wall with a ridge beam supported therefrom.
Figure 2:
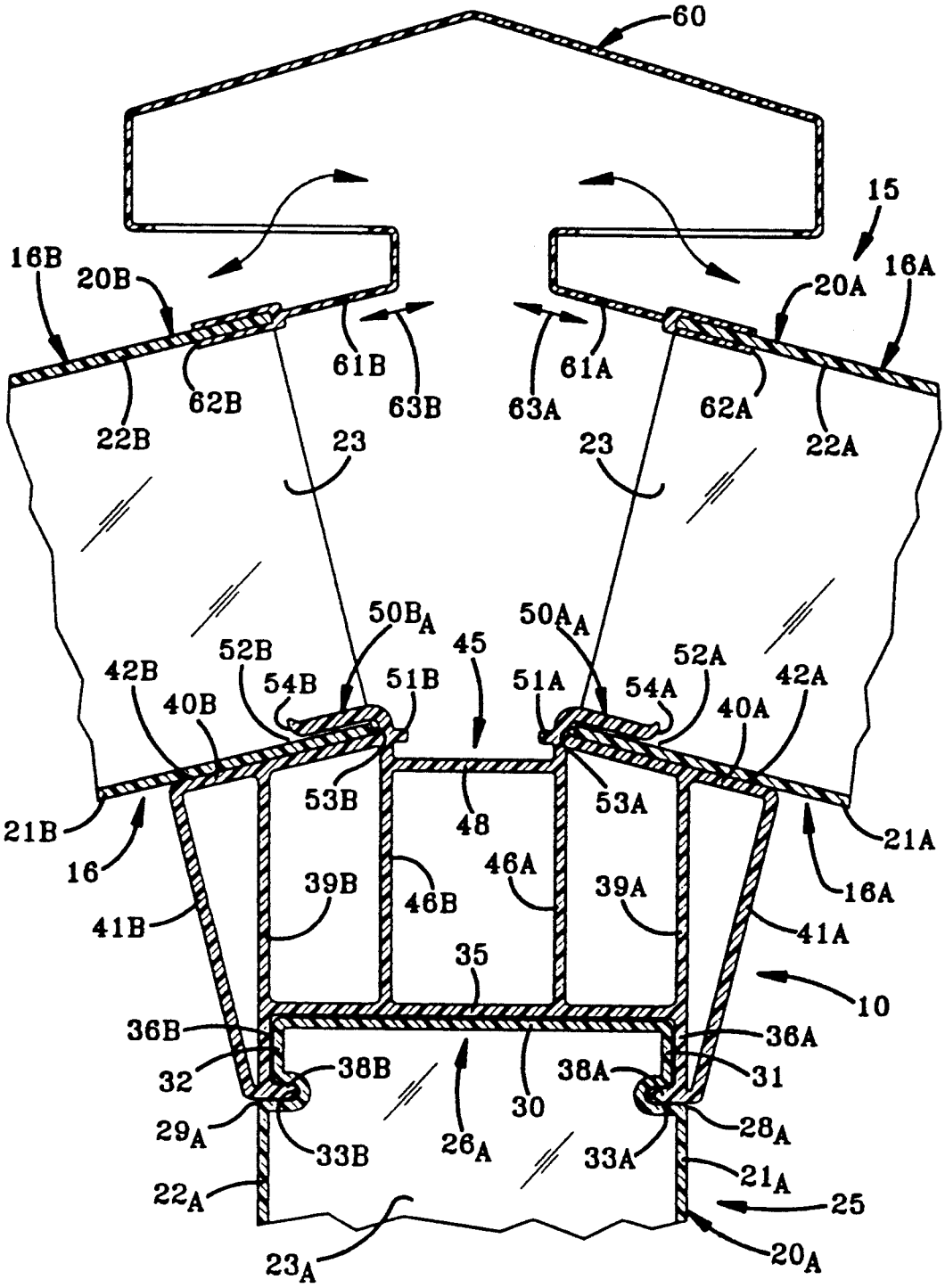
FIG. 2 is an enlarged, vertical section taken substantially along line 2—2 of FIG. 1 to depict one exemplary roof-peak connector means that incorporates a novel ridge cap embodying the concepts of the present invention.
Figure 3:
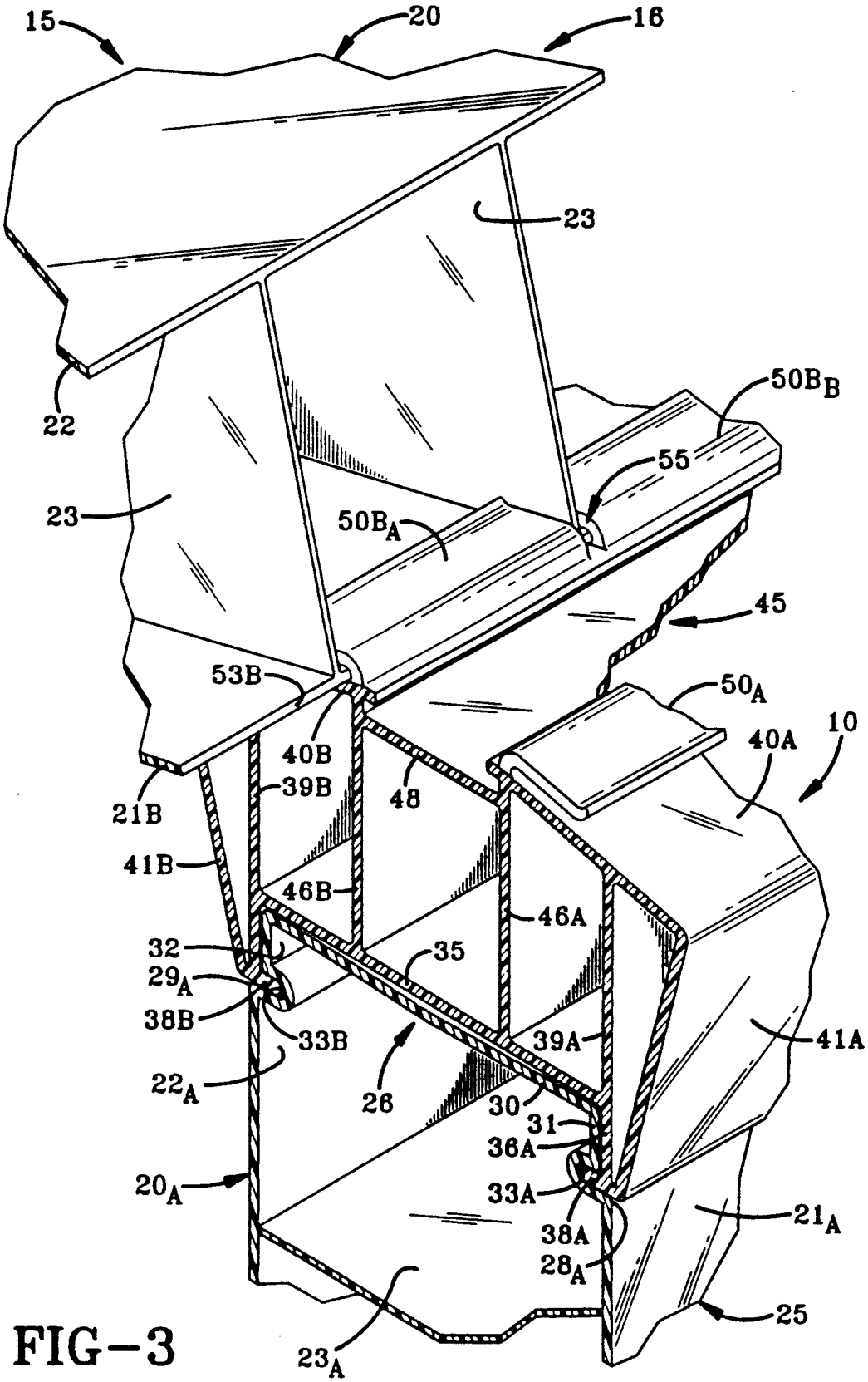
FIG. 3 is a further enlarged, perspective of the exemplary ridge cap depicted in FIG. 2 and with a roof panel connected thereto.

One representative form of a ridge cap means incorporated in a roof-peak connector, and embodying the concepts of the present invention is designated generally by the numeral 10 on FIGS. 2 and 3 of the accompanying drawings. The representative ridge cap 10 may, for example, be employed in the building structure depicted in FIG. 1 which could serve as residential living quarters or a commercial office. The modular building structure 11 depicted employs exterior support walls 12, end walls 13, one or more interior walls 14 and a roof 15, all of which may be of modular construction. The ridge cap means 10 is particularly suited for use with the modular building structure 11.

The composite panel members that constitute the principal component of the walls, and even the roof, of the modular building structure 11 for which the present ridge cap means is particularly suited is the panel member 16. Specifically, the roof 15 is formed by a plurality of longitudinally aligned panel members 16, which are joined by either, or both, of the panel connectors described in considerable detail in my U.S. patent applications, Ser. No. 07/792,356, filed Nov. 14, 1991; Ser. No. 07/875,097, filed Apr. 28, 1992; and, Ser. No. 07/891,426, filed May 29, 1992, which are incorporated herein by reference.

For the purposes of the present invention it is sufficient to note that the two forms of panel connector. The standard, or primary, connector 18 provides an excellent L/R ratio to enhance columnar strength. In addition, the primary panel connector 18 can be readily varied to connect two or more panel members 16 that are linearly and/or perpendicularly disposed, one with respect to the other. The primary connector 18 is, therefore, particularly adapted for use in securing the panel members in a wall arrangement. However, the primary panel connector 18 may, if desired, also be employed to secure the panel members 16 in a roof 15.

There is also a secondary connector 19. The secondary connector 19 is generally employed in arrangements where the L/R ratio is not of particular significance. However, the secondary panel connector 19 does have excellent beam strength, and it may, be highly desirable for use in situations wherein significant bending stresses will be encountered. Hence, the secondary connectors 19 are particularly suited to connect successive panel members 16 in a roof 15, but even in the construction of walls 12, 13 or 14, the secondary coupling connectors 19 may be alternated with the primary panel connectors 18. However, alternating the panel connectors 18 and 19 assumes that sufficient columnar strength for the particular wall can still be achieved—and also assumes that the wall need be secured to its foundation only at the alternate locations of the primary panel connectors 18. Inasmuch as the construction of a roof 15 requires little, if any, resistance to columnar stresses in comparison to the resistance against potentially high bending stresses the secondary coupling connector 19 is particularly suited to usage in the construction of roofs and other beam members.

Briefly, and with reference to FIGS. 2 and 3, the panel members 16 used to form the roof 15 each have a body portion 20. The body portion 20 has planar, transversely spaced, substantially parallel, skin walls 21 and 22. A plurality of reinforcing ribs, or webs, 23 extend transversely between the skin walls 21 and 22. The ribs 23 are, themselves, successively spaced at longitudinal intervals, one with respect to the others, and they are oriented substantially parallel to the longitudinal edges of the body portion 20—i.e., each rib 23 is perpendicularly oriented with respect to the skin walls 21 and 22.

With continued reference to FIGS. 2 and 3, the ridge beam 25, upon which the ridge cap 10 is supported, may be identical too, or closely approximate, a panel member 16. Like the panel members 16 forming the roof 15, and which may also be employed to form the walls 12, 13, and 14 of the building 11, the ridge beam 25 has skin walls $21_A$ and $22_A$ that are interconnected by reinforcing webs $23_A$. The thickness of the skin walls $21_A$ and $22_A$ in a ridge beam 25 may be required to be greater than the thickness of the corresponding skin walls 21 and 22 in a panel members 16 used in a wall 12, 13 or 14 inasmuch as the ridge beam 25 will support the roof 15. Similarly, the panel members 16 used to form the roof 15 may also require thicker skin walls than a similar panel member 16 used to form a wall inasmuch as the walls will be subjected to greater columnar loading than the roof panel members, and the roof panel members will be likely to be subjected to greater bending stresses than will the panel members forming the walls 12, 13 or 14.

As previewed in the previous paragraph, and as will appear in the detailed description which follows, certain suffix conventions will be employed throughout the description appearing herein. For example, a particular structural member, component or arrangement may be employed at more than one location. When referring generally to that type of structural member, component or arrangement a common numerical designation shall be employed. However, when one of structural members, components or arrangements so identified is to be individually identified it shall be referenced by virtue of a letter suffix employed in combination with the numerical designation employed for general identification of that structural member, component or arrangement. A subscript shall also be employed to identify similar, or identical, structural components associated with a member that is employed to accomplish two distinct purposes. For example, the letter subscript convention shall be employed to distinguish the components of a ridge beam 25 from the structure of a panel member 16.

Although not disclosed herein, the longitudinal edges of the panel members 16 utilized to form the walls 12, 13 or 14 and the roof 15 have connecting tongues by which cooperatively to engage panel connectors 18 or 19 and thereby secure the panel members 16 in to a structural unit that constitutes the walls 12, 13 and 14 and/or the roof 15. The details of this arrangement are described in my previously identified, copending application, Ser. No. 07/792,356.

The ridge beam 25 also employs a connecting tongue 26 that is virtually identical to those employed in the panel members from which the walls may be fabricated. With reference, then, to the ridge beam 25 depicted in FIGS. 2 and 3, the body portion $20_A$ is delineated by positioning shoulder $28_A$ and $29_A$ presented at the adjacent, longitudinal edge of each skin wall. That is, the positioning shoulder $28_A$ defines one longitudinal edge of skin wall $21_A$ on bridge member 25, and a corresponding and laterally spaced, positioning shoulder $29_A$ defines the adjacent longitudinal edge of skin wall $22_A$ on ridge beam 25. The positioning shoulders $28_A$ and $29_A$ thus compositely define one longitudinal edge of the body portion $20_A$ on ridge beam 25 as well as the offset junction between the body portion $20_A$ and the connecting tongue $26_A$ which extends longitudinally outwardly from that vertical edge defined by the positioning shoulders $28_A$ and $29_A$ on the body portion $20_A$ of ridge beam 25.

Although not shown herein, positioning shoulders similarly define the opposite longitudinal edge of the ridge beam 25. That arrangement is described in detail in my previously identified U.S. patent application, Ser. No. 07/891,426, filed May 29, 1992, and may be employed to effect a connection between the ridge beam 25 and the interior wall 14.

The connecting tongue $26_A$ has a transversely oriented closure wall 30 that is spaced longitudinally outwardly from the longitudinal edge—defined by the positioning shoulders $28_A$ and $29_A$—of the body portion $20_A$. The transverse edges of the closure wall 30 are joined to transversely spaced, longitudinally extending, locking walls 31 and 32. Vertically extending locking grooves 33A and 33B are recessed into each connecting tongue $26_A$ between each locking wall 31 and 32 and the respective positioning shoulders $28_A$ and $29_A$ of the body portion $20_A$. The locking grooves 33A and 33B lies parallel to shoulders $28_A$ and $29_A$, respectively.

It will be observed that the connecting tongue $26_A$ has a transverse thickness that is less than the transverse thickness of the body portion $20_A$ of the ridge beam 25. This disparity is significant when effecting connections between the panel members 16 and the panel connectors 18 or 19. The purpose for the deliberate disparity is explained in detail in my related applications identified herein. However, that disparity is relatively unimportant when the ridge beam 25 is connected to the ridge cap 10.

The ridge cap 10, the panel members 16, the ridge beam 25, as well as any other structural member which will be hereinafter described, may well comprise an extruded thermoplastic resin. Such resins are preferably reinforced with fibers such as glass fibers to provide a material commonly referred to as a fiber-reinforced plastic (FRP). While a variety of thermoplastic materials and fiber reinforcements are known, one particularly suitable FRP comprises vinyl chloride resins reinforced with glass fibers.

The amount of fiber reinforcement in such a product can range: broadly from about five to fifty percent (5% to 50%) by weight, based upon the combined weight of glass fibers and vinyl chloride resin; desirable from about ten to forty percent (10% to 40%) by weight; preferably from about fifteen to thirty-five percent (15% to 35%) by weight; and, most preferably about thirty percent (30%) by weight. A good disclosure of these products and the process for their preparation can be found in U.S. Pat. No. 4,536,360, the subject matter of which is incorporated herein by reference.

As should be evident to those skilled in the art, practice of the present invention does not require that the structural components comprise vinyl chloride resins reinforced by glass fiber and therefore, the invention is not to be limited thereto or by the disclosure of U.S. Pat. No. 4,536,360. Thus, the structural components may not be fiber reinforced or even thermoplastic so long as they can be manufactured in the configurations described herein.

The preferred ridge cap 10, as depicted in FIGS. 2 and 3, has a base wall 35 which rests on the closure wall 30 of the connecting tongues $26_A$ on the ridge beam 25. A pair of locating flange 36A and 36B, which extend downwardly from the base 35, are disposed in contiguous juxtaposition with the locking walls 31 and 32, respectively, of the connecting tongue $26_A$ and terminate in respective locking pawls 38A and 38B, each of which engage the corresponding locking grooves 33A and 33B associated with the connecting tongue $26_A$ on the ridge beam 25.

The ridge cap 10 includes brace means for supporting the roof panels 16. Typically, the brace means may comprise a pair of brace walls 39A and 39B that extend upwardly from the lateral edges of the base wall 35 to inclined plates 40A and 40B, respectively. Haunched side walls 41A and 41B extend generally diagonally outwardly and upwardly from the respective locating flanges 36A and 36B to intersect, and terminate, at the inclined plates 40A and 40B. Each plate 40 is disposed substantially perpendicularly with respect to the corresponding haunched side walls 41. Each of the inclined plate 40 are also integral with, and constitute the upper termination of, one of the brace walls 39. Moreover, the brace walls 39A and 39B are vertically coplanar with the respective locating flanges 36A and 36B. The three structural members that comprises each brace means—i.e.: a brace wall 39, a plate 40 and a haunched side wall 41—are disposed substantially as a right triangle, the base of which (the plate 40) presents an outer, supporting surface 42 on which the roof panel members 16 are received. That is, the panel member 16A on one side of the ridge rests on supporting surface 42A, and the panel member 16B on the other side of the ridge rests on supporting surface 42B.

The ridge cap 10 also includes a central, reinforcing box portion 45 comprised of risers, or side walls, 46A and 46B that extend vertically upwardly from the base 35 and also interest the respective inclined plates 40A and 40B. A top wall 48 extends between and is integral with the risers 46 near the upper ends thereof. A plurality of longitudinally spaced clip members 50 are attached to the inclined plates 40 in proximity to the opposed, and spaced, ends 51A and 51B thereof. The clip members 50 overlie the support surfaces 42 on each inclined plate 40 to define channels 52 into which the edge 53 of each panel member 116 in the roof 15 is received for frictional retention.

Each clip member 50 has an upwardly curved edge 54 which, when engaged by an edge 53, will act as cam follower to be forced by that edge 53 resiliently to deflect the clip members 50 sufficiently to permit entry of the edge 53 into the appropriate channel 52. That same resilience which permits entry of the edge 53 also effects a frictional engagement of the skin wall 21 between the inclined plate 40 and the clip member 50. The clip member 50 thus provide an upper positioning stop as well as a means by which not only to prevent the roof panel from sliding out of the channel 52 but also to preclude undesirable lifting of the panel members 16 off the inclined plates 40 of the ridge cap 10.

The ridge cap connector means 10 may also be formed by an extrusion process using thermoplastic resin as described above. At the end of the extrusion process, the clip members 50 will extend continuously along the longitudinal axis of the ridge cap 10. However, the roof panel members 16 have reinforcing webs 23 that extend between the skin walls 21 and 22 and which would interfere with the interconnection of the roof panel members 16 and the ridge cap 10 were the clip members 50 to extend continuously uninterrupted along the longitudinal extent of the ridge cap 10.

To accommodate assembly of the roof 15, portions of the clip members 50 are removed, by sawing or other conventional material removal process, thereby leaving a successive series of slits 55 (FIG. 3) which delineate a corresponding series of successive clip members $50A_A$, $50A_B$ (not shown) on panel member 16A, and a corresponding series of clip members $50B_A$, $50B_B$, etc. on panel member 16B. The slits 55 eliminate interference between the clip members 50 and the reinforcing webs 23. Because the spacing of the reinforcing webs 23 is identical from panel member 16 to panel member 16, the spacing of the required material removal is known at the extruding facility such that the sawing operation can be accomplished substantially immediately after the extrusion process. This, of course, eliminates the need for tools, to remove the material, at the erection site.

The clip members $50A_A$, $50A_B$, etc. thus overlie the support surface 42A on inclined plate 40A to define channel 52A within which to receive edge 53A on the skin wall 21A of roof panel member 16A. Likewise, clip members $50B_A$, $50B_B$, etc. thus overlie the support surface 42B on inclined plate 40B to define channel 52B within which to receive edge 53B on the skin wall 21B of roof panel member 16B.

To complete the assembly, a ridge vent 60 may be installed, as shown in FIG. 2. The ridge vent 60 requires no conventional fasteners, such as metal screws or the like, to effect a connection with the opposed roof panels 16A and 16B which meet in spaced relation at the apex of the modular building structure 11. Instead, the terminal portion of each base flange 61A and 61B is bifurcated to present an upper and lower engaging arm 62 and 63, respectively, that are spaced to define a recess 64 by which to embrace the edge 65 of the upper skin wall 22 on the roof panel members 16. By virtue of the resilience of the ridge vent 60, the base flanges 61A and 61B may be depressed and then allowed to snap outwardly (in the direction of the arrows 66A and 66B) releasably to receive the edges 65A and 65B on the skin walls 22A and 22B of the opposed panels 16A and 16B.

Figure 4:
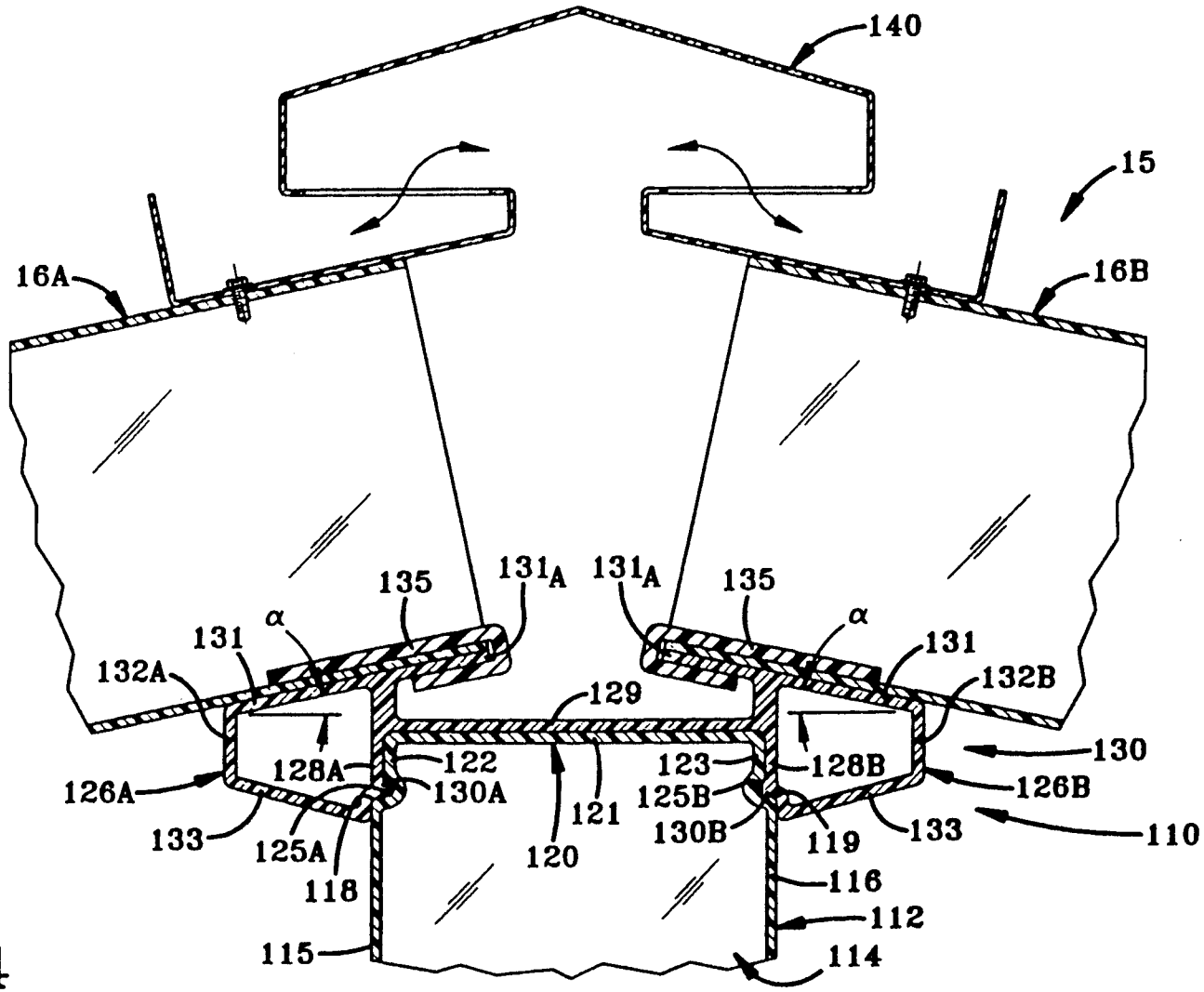
FIG. 4 is a vertical section similar to FIG. 2 but depicting an exemplary roof-peak connector means that incorporates an alternative ridge cap which also embodies the concepts of the present invention.

An alternative ridge cap adapted to close, and join, the roof panels 16A and 16B at the apex of the roof 15 is designated generally at 110 in FIG. 4. The ridge cap 110, which may also be employed as a component in a roof-peak connector means, can be supported from a ridge beam 112. The ridge beam 112, like the ridge beam 25 and the panel members 16, also has a body portion 114 with transversely spaced, substantially parallel, skin walls 115 and 116, with at least the upper edge of each skin wall 115 and 116 terminating in positioning shoulders 118 and 119, respectively. A connecting tongue 120 extends vertically upwardly from the positioning shoulders 118 and 119, which define the offset juncture between the body portion 114 of the ridge beam 112 and the connecting tongue 120.

The tongue 120 also has a transversely oriented closure wall 121 that is spaced vertically upwardly from the longitudinally extending positioning shoulders 118 and 119. The transverse edges of the closure wall 121 are joined to transversely spaced, vertically disposed, and longitudinally extending, locking walls 122 and 123. Longitudinally extending locking grooves 125A and 125B are recessed into the connecting tongue 120 between the respective locking walls 122 and 123 and the reactive shoulders 118 and 119.

The tongue 120 may also have a transverse thickness that is less than the transverse thickness of the body portion 114, and that disparate thickness may be accomplished in the same manner, and for the same purposes, as herein previously described.

The ridge cap 110 cooperatively engages the tongue 120 on the ridge beam 112. Specifically, the ridge cap 110 has a pair of laterally spaced brace members 126A and 126B that may, as shown have trapezoidal cross sections. The central portions of one parallel side 128, preferably the longest, on each trapezoid are conjoined by a horizontal web in the nature of a base 129. The base, or web, 129 overlies the closure wall 121 of the tongue 120, and a longitudinally extending locking pawl 130 projects outwardly from the one parallel side 128 of each brace member 126 to be received within each locking groove 125. The parallel sides 128A and 128B thus serve to embrace the tongue 120 of the ridge beam 112 with the locking pawls 130A and 130B received in the respective grooves 125A and 125B.

Each upper, or plate, wall 131A and 131B presented from a brace member 126A and 126B, respectively, is inclined at the pitch angle $\alpha$ of the roof 15, but the other parallel walls 132A and 132B as well as the exposed side wall 133, respectively, may be disposed in whatever is deemed by the user to be aesthetically pleasing. In the representative embodiment depicted the exposed side walls 133A and 133B are inclined at the same angle $\alpha$ as the opposite plate walls 131B and 131A. As shown, the plate walls 131A and 131B may each be provided with an extension 131A and 131B that projects past the one parallel side 128A and 128B of each brace member 126A and 126B.

Spring clips 135 may be used to secure the roof panels 16A and 16B to the appropriate extension 131A or 131B on each brace member 126, and a ridge vent 140, as is well known to the art, may be used to cover the gap between the roof panels 16 at the apex of the roof 15. The ridge vent 140 does not form a part of the present invention.

As will be appreciated from viewing the embodiments described above, the ridge cap 10 differs from ridge cap 110 by the integrally extruded clip members 50. This eliminates the need to account for, and to maintain, an inventory of the clips 135 which are used with the ridge cap 110. However, both of the embodiments provide for ease of the erection and connection of the roof panel 16 to the ridge cap 10 or 110. Both ridge caps 10 and 110 employ the integral locking pawls 33 and 130 as well as a brace means which improves the support strength of the inclined plates 40 and 131 on the respective ridge caps 10 and 110.

The foregoing description of the exemplary embodiments of the invention have been presented for the purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

As should now be apparent, the present invention not only teaches that ridge cap connector means embodying the concepts of the present invention can be used structurally to join roof panel members to each other with relatively unskilled labor, and without specialized tools but can also accomplish the objects of the invention.

I claim:

1. In combination, a ridge cap, two or more roof panels oppositely inclined at an angular roof pitch and meeting at a roof apex, a modular building structure incorporating a supporting member, the ridge cap securing the roof panels to the modular building structure, said ridge cap comprising:

a horizontally disposed base adapted to engage the supporting member;

oppositely inclined plate means supported from said base and, in turn, supporting the oppositely inclined roof panels at the roof apex;

a brace means interposed between said base and said oppositely inclined plate means;

at least a portion of each said plate means extends upwardly with respect to said base at an angle substantially equal to the angular pitch of the roof;

each said plate means supporting at least one inclined roof panel;

said base having lateral edges;

mounting flange means depending downwardly from said lateral edges and embracing the supporting member;

locking means secured to said inclined plate means and securing each roof panel frictionally to said inclined plate means.

2. A ridge cap, as set forth in claim 1, wherein said brace means comprises:

a brace wall extending upwardly from each edge of said base and intersecting said oppositely inclined plate means.

3. A ridge cap, as set forth in claim 2, further comprising:

a haunched side wall extending diagonally between said mounting flange and said oppositely inclined plate means.

4. A ridge cap, as set forth in claim 3, wherein said locking means further comprises:

at least one wall on each roof panel;

a clip member secured to, and overlying a portion of, said oppositely inclined plate means;

said clip member effecting frictional engagement between the inclined plate means and a skin wall on each roof panel.

5. A ridge cap, as set forth in claim 4, wherein said locking means further comprises:

channels defined between said clip member and each said oppositely inclined plate means to receive a skin wall on each roof panel.

6. A ridge cap, as set forth in claim 5, wherein:

said clip member has sufficient resiliency not only to deflect and permit entry of said skin wall but also to retain said skin wall frictionally within said channel.

7. A ridge cap, as set forth in claim 6, wherein:

said clip member is longitudinally segmented into a successive series of clip members to accommodate structural obstructions which may be presented by said roof panel member.

8. A ridge cap, as set forth in claim 7, wherein:

a plurality of spaced webs extend between the skin walls of the roof panel; and, said clip segments are adapted to be received between said webs.

9. A ridge cap in combination with oppositely inclined panels forming a roof and a modular building structure having a ridge beams, the ridge can securing the opposed roof panels to the ridge beam of the roof in the modular building structure, the roof panels having a central cavity bounded by opposed, generally planar, skin walls, the cavity being accessible from at least one end of each roof panel, said ridge cap comprising:

opposed brace members;

a horizontal web extending between said opposed brace members and forming a base;

said horizontal web resting on the ridge beam;

each said brace member presenting an inclined plate portion upon which one or more roof panels may be supported;

locking means in the form of a clip member simultaneously engaging said inclined plate portion and the roof panel supported thereon and securing each said roof panel frictionally to said inclined plate portion.

* * * * *